US011713915B2

(12) United States Patent
Wang et al.

(10) Patent No.: US 11,713,915 B2
(45) Date of Patent: Aug. 1, 2023

(54) AIR SUPPLY ASSEMBLY, AIR SUPPLY SYSTEM AND REFRIGERATOR

(71) Applicant: HAIER SMART HOME CO., LTD., Shandong (CN)

(72) Inventors: Ning Wang, Qingdao (CN); Guangrui Wu, Qingdao (CN); Hongliang Li, Qingdao (CN); Penghui Li, Qingdao (CN); Xiao Ding, Qingdao (CN); Chang Liu, Qingdao (CN); Chaoge Xu, Qingdao (CN); Xing Liang, Qingdao (CN); Qing Chen, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 90 days.

(21) Appl. No.: 16/961,077

(22) PCT Filed: Jan. 8, 2019

(86) PCT No.: PCT/CN2019/070868

§ 371 (c)(1),
(2) Date: Jul. 9, 2020

(87) PCT Pub. No.: WO2019/137375

PCT Pub. Date: Jul. 18, 2019

(65) Prior Publication Data

US 2021/0063074 A1 Mar. 4, 2021

(30) Foreign Application Priority Data

Jan. 9, 2018 (CN) ..... 201810019798.2
Jan. 9, 2018 (CN) ..... 201810020183.1
(Continued)

(51) Int. Cl.
*F25D 17/06* (2006.01)

(52) U.S. Cl.
CPC ..... *F25D 17/065* (2013.01); *F25D 17/067* (2013.01); *F25D 2317/067* (2013.01); *F25D 2317/0681* (2013.01)

(58) Field of Classification Search
CPC ..... F25D 17/067; F25D 17/065; F25D 2317/0681; F25D 2317/067; F25D 17/06;
(Continued)

(56) References Cited

U.S. PATENT DOCUMENTS 3,004,400 A 10/1961 Mann et al.
3,365,118 A 1/1968 Winfield, Jr.
(Continued)

FOREIGN PATENT DOCUMENTS

CN 202835994 U 3/2013
CN 103673465 A 3/2014
(Continued)

OTHER PUBLICATIONS

Zhang et al, Cn 104374138A, 2015, Hefei Hualing Co Ltd.*
(Continued)

*Primary Examiner* — Elizabeth J Martin
*Assistant Examiner* — Dario Antonio Deleon
(74) *Attorney, Agent, or Firm* — Alston & Bird LLP

(57) ABSTRACT

An air supply assembly for a refrigerator, includes: an air duct cover plate defining, together with a refrigerator liner, an air supply space and configured to isolate the air supply space from a storage space in a compartment of the refrigerator, and a centrifugal wind wheel arranged in the air supply space, and axially sucking air in and blowing the air out towards a peripheral side, wherein a plurality of air return ports are provided in the air duct cover plate to allow air in the storage space to enter the air supply space; and the centrifugal wind wheel abuts against an inner side of the air duct cover plate and is configured to suck air in from a rear
(Continued)

side thereof, such that air entering the air supply space via the air return ports is sucked in from the rear side of the centrifugal wind wheel.

15 Claims, 10 Drawing Sheets

(30) Foreign Application Priority Data

Jan. 9, 2018 (CN) ..... 201810020184.6
Jan. 9, 2018 (CN) ..... 201810020188.4

(58) Field of Classification Search
CPC ..... F25D 17/08; F25D 17/045; F25D 17/042; F25D 21/14; F25D 2317/063; F25D 2317/0683; F25D 2321/1441
See application file for complete search history.

(56) References Cited

U.S. PATENT DOCUMENTS

| | | | | | |
|---|---|---|---|---|---|
| 3,375,677 | A * | 4/1968 | Bright et al. | F25D 17/065 | 62/89 |
| 3,893,307 | A * | 7/1975 | Jacobs | F25D 21/14 | 62/150 |
| 8,359,880 | B2 * | 1/2013 | Lee | F25D 17/06 | 62/419 |
| 2010/0242525 | A1 * | 9/2010 | Park | F25D 17/06 | 62/440 |
| 2016/0090994 | A1 * | 3/2016 | Simpson | F04D 29/646 | |
| 2017/0284724 | A1 * | 10/2017 | Lee et al. | F25D 17/06 | |

FOREIGN PATENT DOCUMENTS

| | | | | | |
|---|---|---|---|---|---|
| CN | 104101159 | A | | 10/2014 | |
| CN | 104374138 | A | * | 2/2015 | F25D 2317/067 |
| CN | 104374138 | A | | 2/2015 | |
| CN | 104374138 | A1 | * | 2/2015 | F25D 2317/067 |
| CN | 104792085 | A | * | 7/2015 | F25D 17/062 |
| CN | 104792085 | A | | 7/2015 | |
| CN | 104792085 | A | * | 7/2015 | F25D 17/062 |
| CN | 204438646 | U | | 7/2015 | |
| CN | 105115218 | A | * | 12/2015 | F25D 17/06 |
| CN | 105115218 | A | * | 12/2015 | F25D 17/06 |
| CN | 105402978 | A | | 3/2016 | |
| CN | 106123443 | A | | 11/2016 | |
| CN | 1065 0043 8 | A | | 3/2017 | |
| CN | 106839572 | A | | 6/2017 | |
| CN | 104792085 | B | | 9/2017 | |
| CN | 107192198 | A | | 9/2017 | |
| JP | H07260315 | A | | 10/1995 | |
| KR | 20000051163 | A | | 8/2000 | |
| WO | WO-2009/061071 | A2 | | 5/2009 | |
| WO | WO-2013/029686 | A1 | | 3/2013 | |

OTHER PUBLICATIONS

Zhang et al, CN104792085A, 2015, Hefei Hualing Co Ltd.*
Lu et al, CN105115218A, 2015, Hefei Hualing Co Ltd.*
CN-104792085-A Translation (Year: 2015).*
CN-104374138-A1 Translation (Year: 2015).*
CN-105115218-A Translation (Year: 2015).*
1st Search Report for CN201810019798.2 dated Nov. 26, 2019 (3 pages).
1st Office Action for CN201810019798.2 dated Dec. 3, 2019 (4 pages).
1st Search Report for CN201810020183.1 dated Nov. 26, 2019 (3—pages).
1st Office Action for CN201810020183.1 dated Dec. 3, 2019 (4 pages).
1st Search Report for CN201810020188.4 dated Nov. 26, 2019 (3 pages).
1st Office Action for CN201810020188.4 dated Dec. 3, 2019 (4 pages).
International Search Report for PCT/CN2019/070868 dated Mar. 20, 2019 (3 pages).
Written Opinion for PCT/CN2019/070868 dated Mar. 20, 2019 (3 pages).
Extended European Search Report for EP Application No. 19739003.2 dated Dec. 21, 2020 (4 pages).
1st Office Action for EP Application No. 19739003.2 dated Jan. 19, 2021 (6 pages).
2nd Office Action for EP Application No. 19739003.2 dated Jun. 18, 2021 (7 pages).

* cited by examiner

A - A

AIR SUPPLY ASSEMBLY, AIR SUPPLY SYSTEM AND REFRIGERATOR

CROSS-REFERENCE TO RELATED APPLICATIONS

The present application is a national phase entry of International Application No. PCT/CN2019/070868, filed Jan. 8, 2019, which claims priority to Chinese Patent Application Nos. 201810020188.4, 201810019798.2, 201810020183.1 and 201810020184.6, filed Jan. 9, 2018, respectively, which are incorporated herein by reference in their entirety.

FIELD OF THE INVENTION

The present invention relates to the technical field of refrigeration and freezing, and particularly relates to an air supply assembly and an air supply system for a refrigerator, and the refrigerator provided with the air supply assembly and the air supply system.

BACKGROUND OF THE INVENTION

The rear side of a refrigerating compartment of an existing dual-system refrigerator is generally provided with an air duct for supplying cooling capacity to the refrigerating compartment, and a fan in the air duct and the structure of the air duct occupy a certain volume of the refrigerating compartment, which is not conducive to the effective use of the compartment space.

BRIEF DESCRIPTION OF THE INVENTION

An objective of the present invention is to provide an air supply assembly for a refrigerator, which occupies a small space.

Another objective of the present invention is to avoid a too low negative pressure in a side compartment of a storage space of a refrigerator compartment.

A further objective of the present invention is to simplify the assembly of the air supply assembly.

Specifically, the present invention provides an air supply assembly for a refrigerator, comprising:

an air duct cover plate which defines an air supply space together with a refrigerator liner and is configured to isolate the air supply space from the storage space in the compartment of the refrigerator, and a centrifugal wind wheel which is arranged in the air supply space, axially sucks air in and blows out the air to a peripheral side, wherein the air duct cover plate is provided with a plurality of air return ports for allowing the air in the storage space to enter the air supply space; and the centrifugal wind wheel abuts against the inner side of the air duct cover plate and is configured to suck air in from the rear side so as to suck the air entering the air supply space via the air return ports in from the rear side of the centrifugal wind wheel.

Optionally, the region of the liner corresponding to the centrifugal wind wheel is configured to protrude outward away from the air duct cover plate so as to increase the air supply space on the air suction side of the centrifugal wind wheel.

Optionally, the air supply assembly is configured to be located on the rear side of the lower part of the compartment, and an airflow channel is arranged above the air supply assembly;

an evaporator is arranged in the airflow channel, and the airflow channel is provided with an air supply port for supplying air to the storage space; and the centrifugal wind wheel is configured to enable the air to accelerate upward and flow into the airflow channel and flow to the air supply port through the evaporator.

Optionally, the air duct cover plate is directly mounted and fixed on the refrigerator liner, the inner side of the air duct cover plate is provided with a fan volute, and the centrifugal wind wheel is arranged in the fan volute.

Optionally, the fan volute is formed on the inner side of the air duct cover plate so as to mount the centrifugal wind wheel; and the fan volute is configured to be integrally formed with the air duct cover plate.

Optionally, the air supply assembly also comprises:

a fan rear cover which is arranged between the centrifugal wind wheel and the liner and is configured to cover the outside of the centrifugal wind wheel from the rear side of the centrifugal wind wheel, wherein the fan rear cover is provided with an air suction port for allowing the centrifugal wind wheel to suck the air in the air supply space in through the air suction port;

the fan rear cover, the fan volute and the centrifugal wind wheel constitute a centrifugal fan; and the fan volute is provided with a locating notch, the fan rear cover is provided with a locating pillar extending forward from the front surface of the fan rear cover, and the locating pillar is inserted into the locating notch when the fan rear cover is mounted on the inner side of the air duct cover plate.

Optionally, the fan rear cover is configured to be directly mounted and fixed on the air duct cover plate between the centrifugal wind wheel and the liner.

Optionally, the air duct cover plate comprises a main part and a guide part, and the fan volute is arranged on the inner side of the main part;

the main part is configured to be arranged away from the liner with respect to the airflow channel; and the guide part is configured to bend and extend upward from the top end of the main part and toward the liner to guide the air blown out by the centrifugal wind wheel to flow to the airflow channel.

Optionally, the main part is provided with at least one air return group, and each air return group comprises a plurality of air return ports;

the air return group is configured to be located in a region close to a transverse end of the main part; and the projections of the plurality of air return ports of the air return group on the air duct cover plate are located outside the projection of the fan volute on the air duct cover plate.

Optionally, the air supply assembly also comprises:

a plurality of shielding caps which are configured to be respectively arranged above the plurality of air return ports of the air return group on the side of the storage space so as to shield the air return ports from the upper side, so that the air in the storage space flows to the inner sides of the shielding caps from bottom to top and enters the air return ports.

Optionally, at least one transverse side end of the air duct cover plate is provided with a side cover plate which bends and extends toward the liner; and the side cover plate is provided with at least one air return port.

The present invention also provides an air supply system for a refrigerator, comprising any one of the above air supply assemblies, and an evaporator which is arranged above the centrifugal wind wheel and is configured to exchange heat with the air flowing through the evaporator, wherein the centrifugal wind wheel is configured to axially suck air in from the centrifugal wind wheel and blow out the air upward; and a part of the liner located below the evaporator is configured to bend and extend toward the air duct cover plate so as to form a water collecting bottom, and the part of the liner enables the projection of the evaporator in a vertical direction to be in the water collecting bottom.

Optionally, a part of the liner located below the evaporator and located above the water collecting bottom is configured to protrude away from the air duct cover plate so as to form a water collecting side;

the water collecting bottom is configured to ensure that the side close to the air duct cover plate is higher than the side close to the water collecting side, so that water droplets falling on the water collecting bottom flow toward the water collecting side; and the junction of the water collecting side and the water collecting bottom is configured to have an inclination angle to ensure that the middle location is lower than other locations away from the middle location, and the middle location is provided with a drain opening for guiding the liquid flowing to the junction to flow out from the drain opening.

The present invention also provides a refrigerator which is provided with a refrigerator body comprising at least one compartment and any one of the above air supply assemblies, wherein the at least one compartment is a refrigerating compartment, and the air supply assembly is arranged in the refrigerating compartment.

The air supply assembly of the present invention has an air return path from the air return ports on the front side of the centrifugal wind wheel to the air suction port on the rear side of the centrifugal wind wheel, so that a gap does not need to be reserved between the centrifugal wind wheel and the air duct cover plate so as to increase the volume of the storage space in front of the air duct cover plate.

Further, according to the air supply assembly of the present invention, the air return path is set to bypass the main body of the centrifugal wind wheel from front to rear so as to avoid that the air just entering the air supply space via the air return ports suddenly changes the flow direction to extend the air return path, so that the air return flow is gentle to reduce the air return noise and avoid a too low negative pressure on the side of the storage space.

Further, the fan rear cover of the present invention can be fixed on the air duct cover plate and mounted on the liner through the air duct cover plate, so that the centrifugal fan and the air duct cover plate together constitute a modularized component so as to further simplify the assembly process of the air supply assembly.

BRIEF DESCRIPTION OF THE DRAWINGS

Some specific embodiments of the present invention are described in detail below with reference to the accompanying drawings by way of examples without limitation. The same reference numerals in the accompanying drawings mark the same or similar components or parts. Those skilled in the art should understand that the accompanying drawings are not necessarily drawn in scale. In the accompanying drawings.

DETAILED DESCRIPTION

Figure 1:
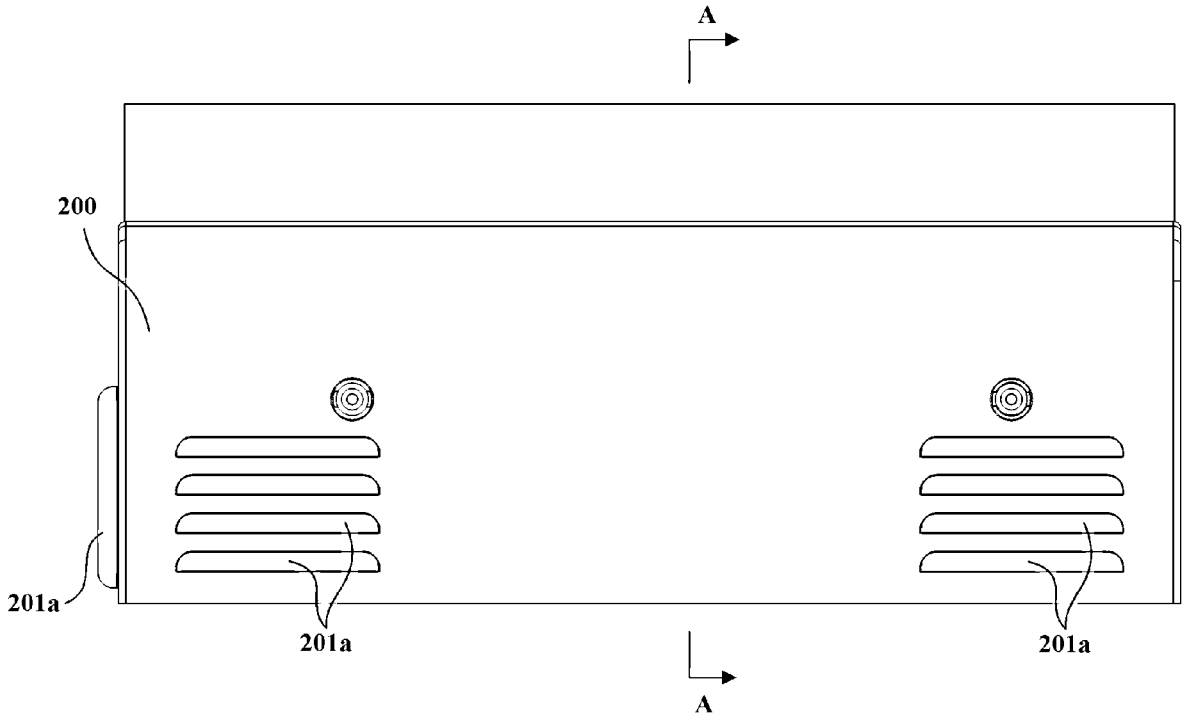
FIG. 1 is a schematic front view of an air supply assembly according to an embodiment of the present invention.
Figure 2:
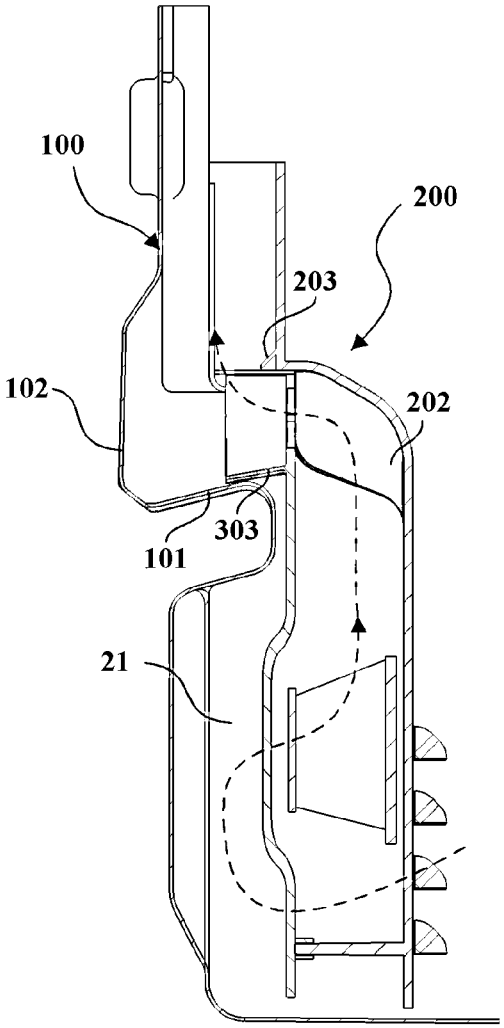
FIG. 2 is a schematic cross-sectional view taken along a section line A-A in FIG. 1, wherein the dotted line with an arrow shows the air flow direction.

The present invention provides an air supply assembly for a refrigerator. The air supply assembly can be further comprised in an air supply system and applied to the refrigerator. In general, the refrigerator is provided with a refrigerator body housing as an outer surface and a liner located in the refrigerator body housing. The liner can define a compartment, and at least a part of space in the compartment can serve as a storage space. A plurality of compartments can be arranged, and a refrigerating compartment, a freezing compartment or a temperature-variable compartment can be arranged according to needs. Further, in general, airflow channels are arranged in refrigerating compartments of some air-cooled or dual-system refrigerators so as to provide refrigerating air to the storage spaces of the refrigerating compartments. An air supply assembly can be arranged in an airflow channel to form fast flowing air, or the airflow channel and the air supply assembly can together constitute an air supply system for providing cooling air to the refrigerating compartment. The air supply assembly can be arranged on the most upstream side of the air supply system. It can be understood that the most upstream side refers to the source of an air supply path and is not the actual mounting location of the air supply assembly.

An air supply system for a refrigerator can comprise an air supply assembly and a heat exchange device. Referring to FIG. 1 to FIG. 4, the air supply assembly can comprise an air duct cover plate 200 and a centrifugal wind wheel 400. The air duct cover plate 200 can be arranged substantially in parallel with a liner 100 of a refrigerator compartment 1 to define an air supply space 20 together with the liner 100 of the refrigerator compartment, and is configured to isolate the air supply space 20 from a storage space 10 in the compartment 1. The centrifugal wind wheel 400 can be arranged in the air supply space 20, axially sucks air in and blows out the air to a peripheral side. The heat exchange device can be an evaporator 500 which is arranged above the centrifugal wind wheel 400 and is configured to exchange heat with the air flowing through the evaporator 500. Further, the air duct cover plate 200 can be provided with a plurality of air return ports 201 for allowing the air in the storage space 10 to enter the air supply space 20. Specifically, the centrifugal wind wheel 400 abuts against the inner side of the air duct cover plate 200 and is configured to suck air in from the rear side so as to suck the air entering the air supply space 20 via the air return ports 201 in from the rear side of the centrifugal wind wheel 400. It can be understood by those skilled in the art that the inner side of the air duct cover plate 200 refers to one side of the air duct cover plate 200 facing the air supply space 20. For the convenience of description, the "upper", "lower", "front" and "rear" and other directions mentioned in the specification are all defined according to the spatial location relationship in a normal working state of the refrigerator. For example, the side of the refrigerator facing a user is the front, and the side of the refrigerator facing the wall of the placing location is the rear.

Specifically, the air duct cover plate 200 can be arranged in front of the liner 100 on the rear side of the refrigerator compartment 1 so as to form an air supply space 20 on the rear side of the compartment 1. The air return ports 201 formed in the air duct cover plate 200 allow the air in the storage space 10 to flow into the air supply space 20 from front to rear. Therefore, the centrifugal wind wheel 400 is configured to suck air in from the rear side to enable the air entering the air supply space 20 to continue to flow backward and to flow toward the center of the centrifugal wind wheel 400 at a location substantially behind the centrifugal wind wheel 400 and to be sucked therein.

The air supply assembly of the present invention has an air return path from the air return ports 201 on the front side of the centrifugal wind wheel 400 to the air suction port 302 on the rear side of the centrifugal wind wheel 400, so that a gap does not need to be reserved between the centrifugal wind wheel 400 and the air duct cover plate 200 so as to increase the volume of the storage space 10 in front of the air duct cover plate 200.

According to the air supply assembly of the present invention, the air return path is set to bypass the main body of the centrifugal wind wheel 400 from front to rear so as to avoid that the air just entering the air supply space 20 via the air return ports 201 suddenly changes the flow direction to enable the air return flow to be smoother and simultaneously extend the air return path, so that the air return flow is gentle to reduce the air return noise and avoid a too low negative pressure on the side of the storage space because a large amount of air is pumped to the side of the air supply space in a short time and gathered at the centrifugal wind wheel, and then, a user can conveniently open refrigerator doors.

In some embodiments of the present invention, the inner side of the air duct cover plate 200 can be provided with a fan volute 204, and the centrifugal wind wheel 400 can be arranged in the fan volute 204. Specifically, the fan volute 204 and the air duct cover plate 200 can be integrally formed, that is, the fan volute 204 is formed on the inner side of the air duct cover plate 200, and the air duct cover plate 200 can be directly mounted and fixed on the liner 100 of the refrigerator compartment 1 through connecting pieces so as to reduce the parts of the air supply assembly and simplify the assembly process of the air supply assembly.

Figure 5:
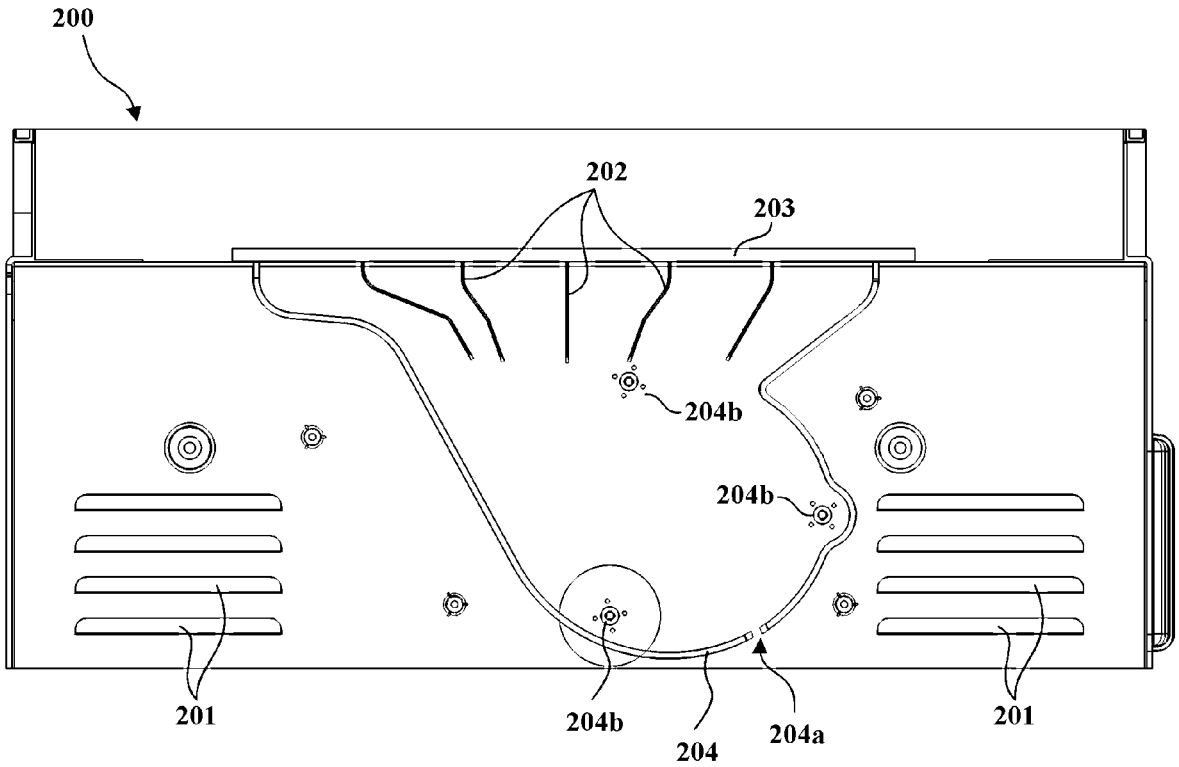
FIG. 5 is a schematic rear view of an air duct cover plate according to an embodiment of the present invention.
Figure 6:
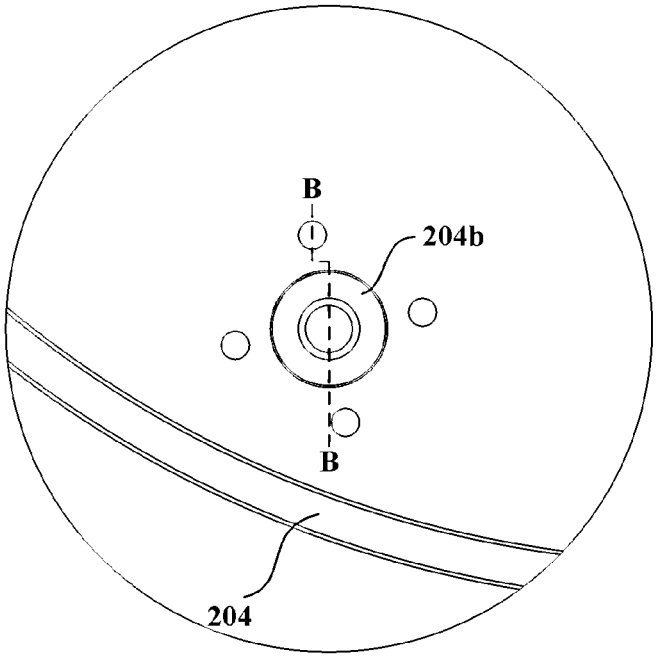
FIG. 6 is a schematic partial enlarged view of an air duct cover plate as shown in FIG. 5, wherein a blind hole is shown.
Figure 7:
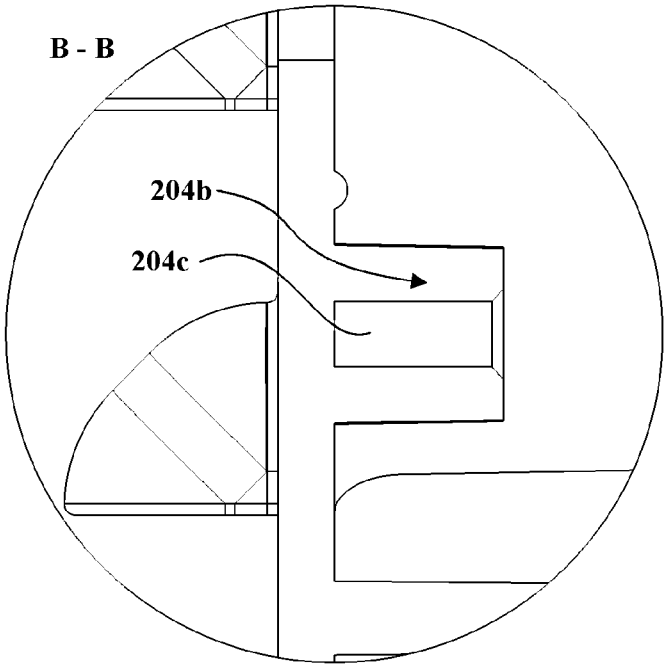
FIG. 7 is a schematic cross-sectional view taken along a section line B-B in FIG. 6.

Specifically referring to FIG. 5 to FIG. 7, a plurality of blind holes 204*b* are arranged on the inner side of the air duct cover plate 200 and located in the inner region of the fan volute 204, and the center of each blind hole 204*b* protrudes outward to form a mounting pillar 204*c*. The peripheral side of the centrifugal wind wheel 400 is provided with a plurality of mounting rings 400*a* which are configured to be annular so as to be embedded in the blind holes 204*b* and sheathed on the mounting pillars 204*c* in the blind holes 204*b*, so that the mounting location of the centrifugal wind wheel 400 is limited.

Figure 8:
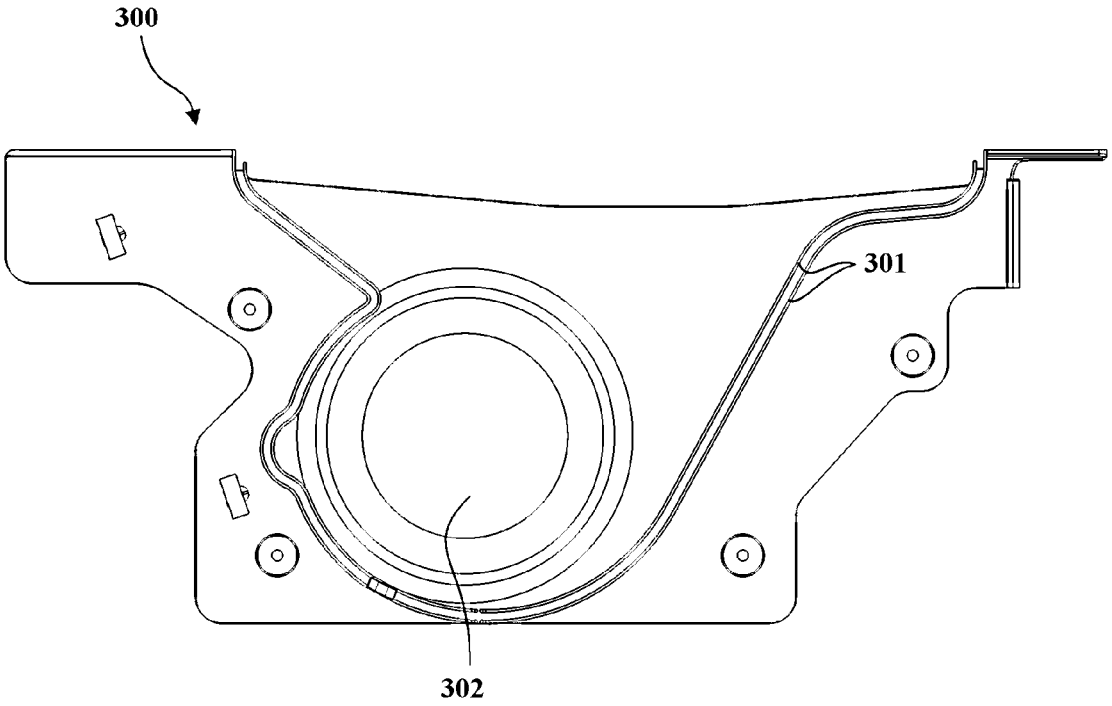
FIG. 8 is a schematic front view of a fan rear cover according to an embodiment of the present invention.
Figure 9:
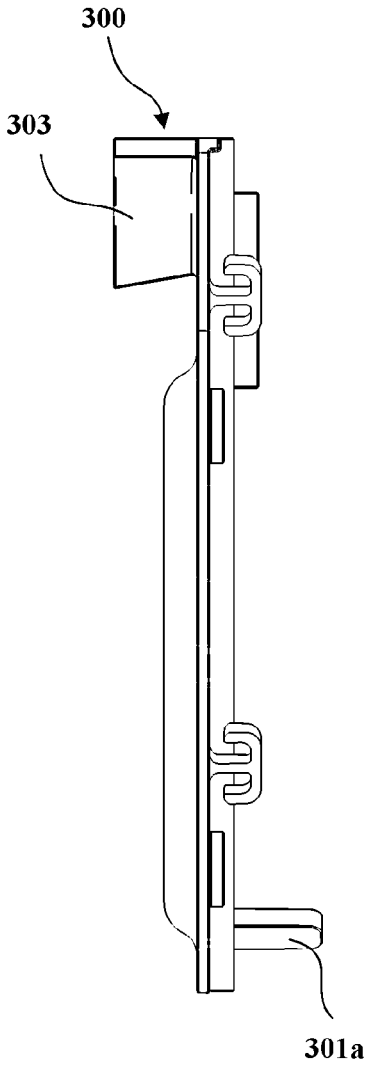
FIG. 9 is a schematic side view of a fan rear cover according to an embodiment of the present invention.

In some embodiments of the present invention, referring to FIG. 8 and FIG. 9, the air supply assembly also comprises a fan rear cover 300 which is arranged between the centrifugal wind wheel 400 and the liner 100 and is configured to cover the outside of the centrifugal wind wheel 400 from the rear side of the centrifugal wind wheel 400, thereby protecting the centrifugal wind wheel 400. Specifically, the fan rear cover 300 can be configured to be directly mounted and fixed on the air duct cover plate 200 between the centrifugal wind wheel 400 and the liner 100. The fan rear cover 300 is provided with an air suction port 302 for allowing the centrifugal wind wheel 400 to suck the air in the air supply space 20 in through the air suction port 302. That is, the fan rear cover 300 and the fan volute 204 constitute a centrifugal fan together with the centrifugal wind wheel 400. Under the limitation of the fan volute 204, the centrifugal wind wheel 400 can axially suck air in and blow the air upward out of the centrifugal fan.

That is, the fan rear cover 300 can be directly fixed on the air duct cover plate 200 and mounted on the liner 100 through the air duct cover plate 200, so that the centrifugal fan constituted by the fan rear cover 300, the fan volute 204 and the centrifugal wind wheel 400 and the air duct cover plate 200 together form a modularized component so as to further simplify the assembly process of the air supply assembly. Furthermore, compared with the centrifugal fan which is directly fixed on the liner 100, the centrifugal fan which is fixed on the air duct cover plate 200 in the present invention has smaller noise during operation.

In some embodiments of the present invention, the fan volute 204 can be provided with a locating notch 204*a*. Correspondingly, the fan rear cover 300 can be provided with a locating pillar 301*a* extending forward from the front surface of the fan rear cover 300, and the locating pillar 301*a* is inserted into the locating notch 204*a* when the fan rear cover 300 is mounted on the inner side of the air duct cover plate 200. The inner side of the fan rear cover 300 can be provided with two layers of convex strips 301 similar to the fan volute 204 in shape, and when the fan rear cover 300 is mounted on the air duct cover plate 200, the end of the fan volute 204 facing the fan rear cover 300 is inserted into the gap between the two layers of convex strips 301. Specifically, the locating notch 204*a* can be arranged on the lower side of the fan volute 204. The locating pillar 301*a* can be arranged between the two layers of convex strips 301, is arc-shaped and has the same radian as the corresponding location of the two layers of convex strips 301 and the fan volute 204, so that the locating pillar 301*a* can be embedded in the locating notch 204*a* to enable the fan volute 204 to be complete.

In some embodiments of the present invention, the air supply assembly is configured to be located on the rear side of the lower part of the compartment 1, and an airflow channel 22 is arranged above the air supply assembly. An evaporator 500 can be arranged in the airflow channel 22, and a part of the airflow channel 22 (in the present embodiment, an upper region of the airflow channel 22) on the downstream side can be provided with an air supply port for supplying air to the storage space 10. Correspondingly, the centrifugal wind wheel 400 can be configured to blow air upward so as to enable the airflow to accelerate upward and flow into the airflow channel 22 and flow to the air supply port through the evaporator 500. That is, in a vertical direction, the air supply assembly can be located below the lowermost layer of a shelf in the compartment 1, thereby saving the upper space of the storage space 10 and increasing the effective volume of the storage space 10.

Figure 3:
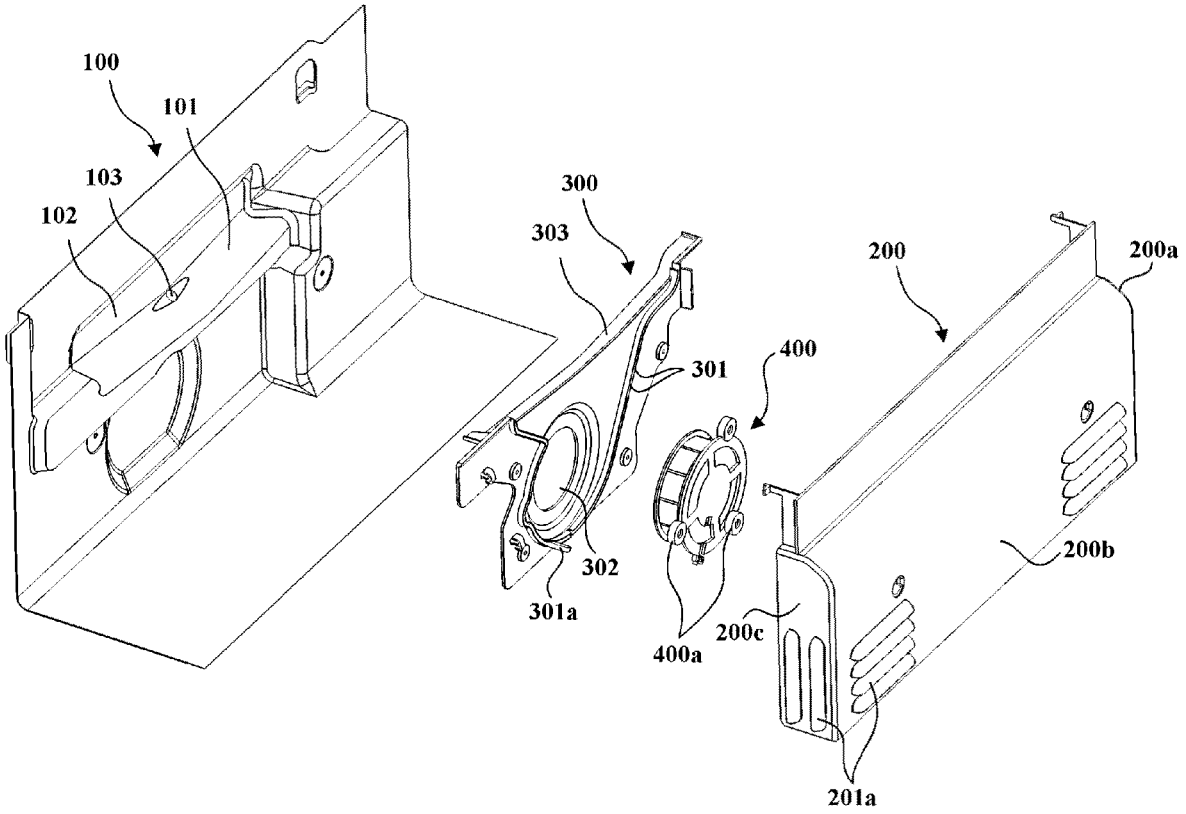
FIG. 3 is a schematic exploded view of an air supply assembly according to an embodiment of the present invention.
Figure 4:
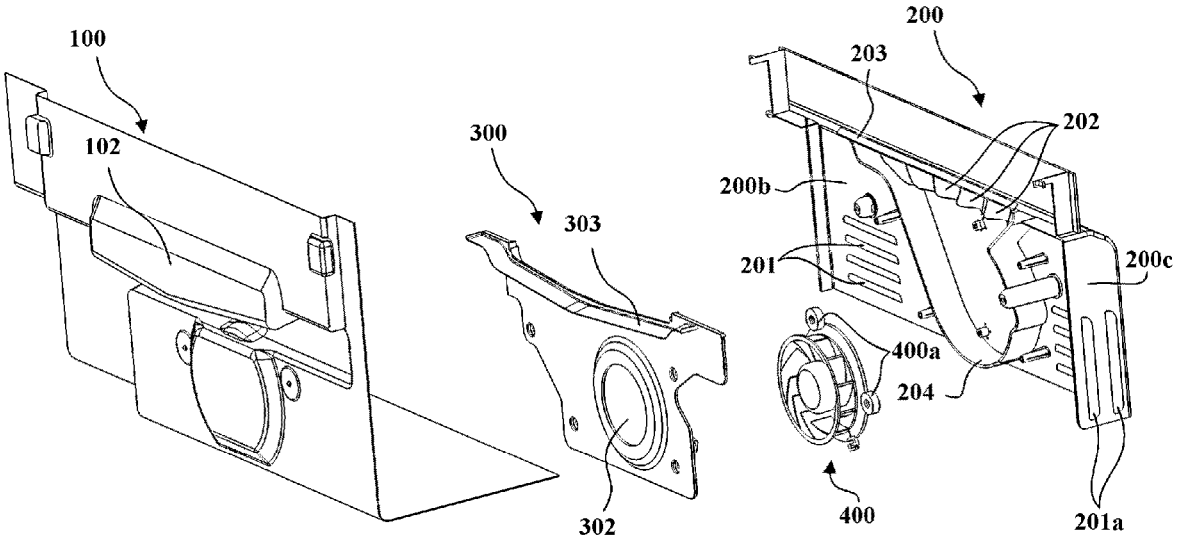
FIG. 4 is a schematic exploded view of an air supply assembly observed from another angle according to an embodiment of the present invention.
Figure 10:
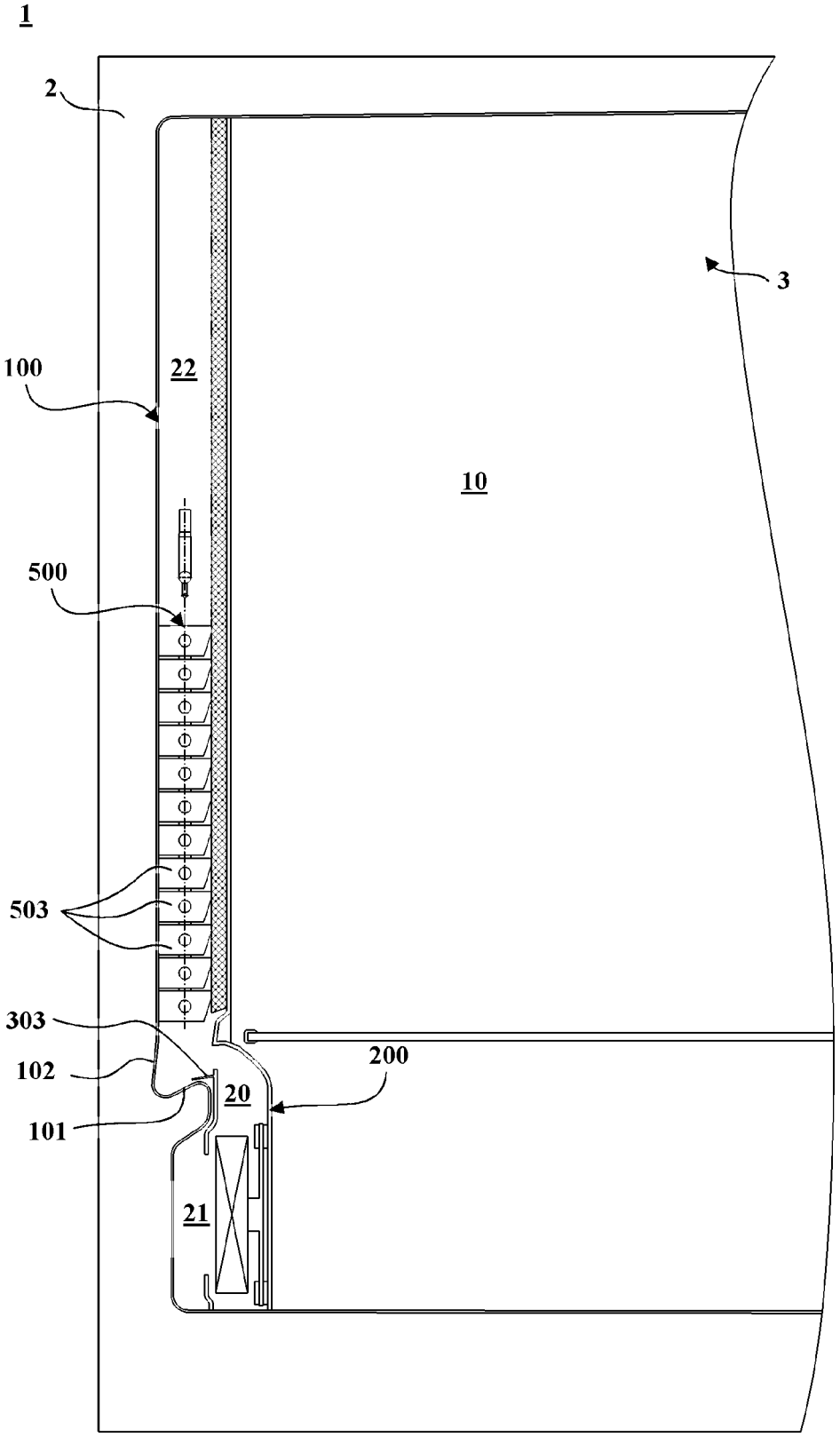
FIG. 10 is a schematic side cross-sectional view of a compartment provided with an air supply assembly according to an embodiment of the present invention.

Referring to FIG. 3 and FIG. 10, the air duct cover plate 200 can comprise a main part 200*b* and a guide part 200*a*, and the fan volute 204 can be arranged on the inner side of the main part 200*b*. Specifically, the air duct cover plate 200 can be composed of an upper part and a lower part, and the guide part 200*a* is located above the main part 200*b*. The main part 200*b* can be configured to be arranged away from the liner 100 with respect to the airflow channel 22. The guide part 200*a* can be configured to bend and extend upward from the top end of the main part 200*b* and toward the liner 100 to guide the air blown out by the centrifugal wind wheel 400 to flow to the airflow channel 22. That is, the guide part 200*a* and the top of the fan rear cover 300 can together define an air supply duct of the centrifugal fan. The guide part 200*a* is closer to one side of the liner 100 with respect to the main part 200*b* over against the centrifugal wind wheel 400, so that the cross-sectional area of the air outlet duct of the centrifugal fan gradually decreases from bottom to top so as to promote the accelerated flow of air. In some embodiments of the present invention, the cover plate for defining the airflow channel 22 can be configured to extend upward from the guide part 200*a* of the air duct cover plate 200. That is, the airflow channel 22 and the air supply space 20 can be isolated from the storage space 10 by the same complete cover plate.

In some embodiments of the present invention, the region of the liner 100 corresponding to the centrifugal wind wheel 400 is configured to protrude outward away from the air duct cover plate 200 so as to increase the air supply space 20 on the air suction side of the centrifugal wind wheel 400. Specifically, the degree that the liner 100 outward protrudes can be greater than the degree that the main part 200*b* moves forward and "occupies" the storage space 10, thereby ensuring the volume of the storage space 10. It can be understood that the "occupies" means that the main part 200*b* is closer to the front side of the refrigerator body with respect to the guide part 200*a*. Because the rear side of the liner 100 is a refrigerator foaming layer, the front and rear locations of the liner 100 do not significantly affect the foaming effect of the foaming layer. Furthermore, because the centrifugal wind wheel 400 which sucks air in from the rear side is arranged close to the main part 200*b*, the main part 200*b* does not need to be arranged at an excessive front location. Compared with the air supply assembly which sucks air in from the front side, the air supply assembly of the present invention reduces the need for the air supply space 20, so that the volume of the storage space 10 is larger.

It can be understood that the above-mentioned "outward protruding" means that the liner 100 faces the outside of the air supply space 20, that is, the liner 100 can face the storage space 10 and can also face the refrigerator foaming layer on the rear side of the liner 100.

The present invention also provides an air supply system. The air supply system can comprise the above air supply assembly, a heat exchange device (such as the evaporator 500) and a refrigerator liner, wherein at least a part of the refrigerator liner is used for auxiliary delivery of refrigerating air.

Figure 11:
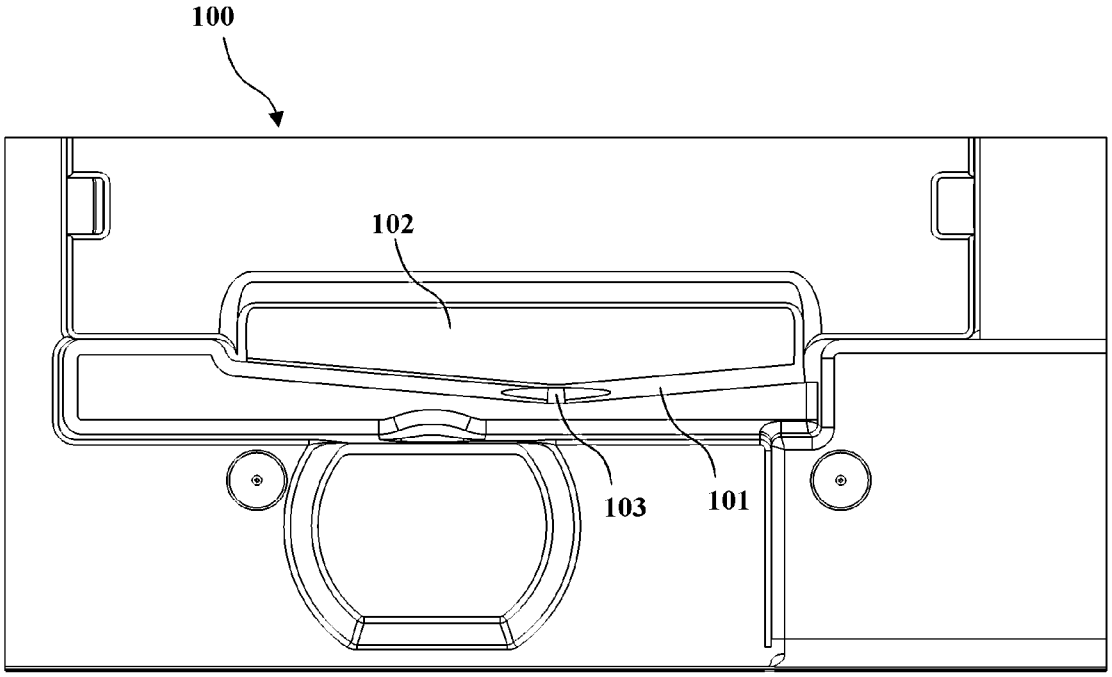
FIG. 11 is a schematic front view of a part of liner according to an embodiment of the present invention.

Referring to FIG. 11, a part of the liner 100 located below the evaporator 500 in the air supply system is configured to bend and extend toward the air duct cover plate 200 so as to form a water collecting bottom 101, so that the projection of the evaporator 500 in a vertical direction is in the water collecting bottom 101. That is, a water collecting groove of the refrigerator can be directly formed by bending and extending the liner 100 without being additionally arranged.

Specifically, a part of the liner 100 located below the evaporator 500 and located above the water collecting bottom 101 is configured to protrude away from the air duct cover plate 200 so as to form a water collecting side 102. The water collecting bottom 101 is configured to ensure that the side close to the air duct cover plate 200 is higher than the side close to the water collecting side 102, so that water droplets falling on the water collecting bottom flow toward the water collecting side 102. Further, the junction of the water collecting side 102 and the water collecting bottom 101 is configured to have an inclination angle to ensure that the middle location is lower than other locations away from the middle location, and the middle location is provided with a drain opening 103 for guiding the liquid flowing to the junction to flow out from the drain opening 103.

In some embodiments of the present invention, the water collecting side 102 can be configured to protrude toward the foaming layer so as to further guide the junction of the water collecting bottom 101 and the water collecting side 102 to incline downward and be away from the air outlet duct.

The air supply system of the refrigerator of the present invention does not require the use of additional water collecting groove parts, and guides the defrosting water generated in the air supply system to be discharged through the liner 100 having a water collecting shape, thereby further lowering the manufacturing cost of the refrigerator, completely discharging the defrosting water, and simultaneously avoiding the matched mounting of the water collecting groove structure and the liner 100.

In some embodiments of the present invention, the air supply assembly can also comprise a plurality of guide ribs 202 which are arranged on the inner side of the air duct cover plate 200 and can be configured to be located on the downstream side of the air outlet path of the centrifugal wind wheel 400 so as to equally divide the airflow blown out by the centrifugal wind wheel 400 into multiple strands. In general, the air duct cover plate 200 has a certain width, and the plurality of guide ribs 202 are sequentially arranged along the transverse direction of the air duct cover plate 200. Specifically, the plurality of guide ribs 202 can be configured to be arranged on the inner side of the guide part 200*a* at the same interval so as to equally divide the airflow blown out by the centrifugal wind wheel 400 into multiple strands, and multiple strands of airflow respectively flow backward and upward between every two adjacent guide ribs 202. Therefore, the air blown out by the centrifugal wind wheel 400 uniformly flows to the peripheral side of the evaporator 500 in the airflow channel 22 through the plurality of guide ribs 202 so as to improve the heat exchange efficiency of the evaporator 500.

In some embodiments of the present invention, a water stop strip 203 can be arranged above the plurality of guide ribs 202 so as to prevent water droplets from entering the centrifugal fan. Specifically, the water stop strip 203 can be arranged at the upper end edge of the guide part 200*a* facing the liner 100, and has a downward inclined angle in a direction from the air duct cover plate 200 to the liner 100 so as to shield a part of the opening of the air supply duct from the upper side. Because the guide part 200*a* guides the air blown out by the centrifugal fan to supply air backward, the water stop strip 203 located above the guide ribs 202 will not generate adverse effects on the air volume and the air speed and other items of the refrigerating air supplied backward.

In some embodiments of the present invention, a shielding strip 303 can be arranged at the top of the fan rear cover 300 and is configured to extend backward from the top of the fan rear cover 300 and overlap on the water collecting bottom 101 so as to shield an air return region 21 between the liner 100 and the fan rear cover 300. That is, the shielding strip 303 at the top end of the fan rear cover 300 completely isolates the air return region 21 from the water collecting liner 100, and guides the liquid thereon to flow toward the water collecting liner 100, thereby completely preventing the condensing water or defrosting water from entering the centrifugal fan. Further, the side, connected to the fan rear cover 300, of the shielding strip 303 can be slightly lower than the top end of the fan rear cover 300, thereby preventing the water droplets falling on the top end of the fan rear cover 300 from splashing into the air outlet duct. Furthermore, the side, connected to the fan rear cover 300, of the shielding strip 303 can be configured to be higher than the side overlapping on the water collecting bottom 101 so as to guide the water droplets thereon to flow toward the water collecting bottom 101.

In some embodiments, the main part 200*b* is provided with at least one air return group, and each air return group comprises a plurality of air return ports 201. The air return group can be configured to be located in a region close to the transverse end of the main part 200*b*, and the projections of the plurality of air return ports 201 of the air return group on the air duct cover plate 200 are all outside the projection of the fan volute 204 on the air duct cover plate 200.

In some embodiments, a plurality of air return ports 201 can be configured to be divided into two air return groups, and each air return group is provided with a plurality of air return ports 201. The two air return groups are respectively arranged at the locations close to two transverse ends of the main part 200*b*. Therefore, the air in the storage space 10 enters the air supply space 20 from the peripheral side (mainly two transverse sides) of the fan volute 204, and the change of the flow direction of the air return flow is gentler so as to avoid many excessive turns. In the present invention, by the arrangement of the air return ports 201 which are located on the peripheral side of the fan volute 204 and the arrangement of the centrifugal wind wheel 400 which sucks air in from the rear side, the turn angle required for air return flow is reduced, and a sufficient space for changing the flow direction is provided for air return flow, so that the air return flow can be continuously and stably sucked in by the centrifugal wind wheel 400.

In some embodiments of the present invention, the air supply assembly also comprises a plurality of shielding caps 201*a*. The plurality of shielding caps 201*a* can be configured to be respectively arranged above the plurality of air return ports 201 of the air return group on the side of the storage space 10 so as to shield the air return ports 201 from the upper side, and the air in the storage space 10 flows to the inner sides of the shielding caps 201*a* from bottom to top and enters the air return ports 201.

Specifically, the air return ports 201 on the main part 200*b* can extend along a transverse direction, and a shielding cap 201*a* is arranged above each transversely extended air return port 201 so as to prevent liquid or solids such as granular debris in the storage space 10 from entering the air supply space 20 with the air.

In some embodiments of the present invention, at least one transverse side end of the air duct cover plate 200 is provided with a side cover plate 200*c* which bends and extends toward the liner 100. The side cover plate 200*c* is provided with at least one air return port 201. Specifically, the side cover plate 200*c* can be formed on a transverse side end of the main part 200*b*. Or, side cover plates 200*c* can be respectively formed at left and right sides of the main part 200*b*. The side cover plate 200*c* can backward abut against the liner 100 so as to isolate the air supply space 20 from the storage space 10. Each side cover plate 200*c* can be provided with a plurality of air return ports 201 so as to promote air circulation in the compartment 1 and improve the heat exchange efficiency. The air return ports 201 on the side cover plate 200*c* can be configured to extend along a vertical direction, and the front side (that is, the side close to the storage space 10) of each air return port 201 is provided with a shielding cap 201*a*.

Figure 12:
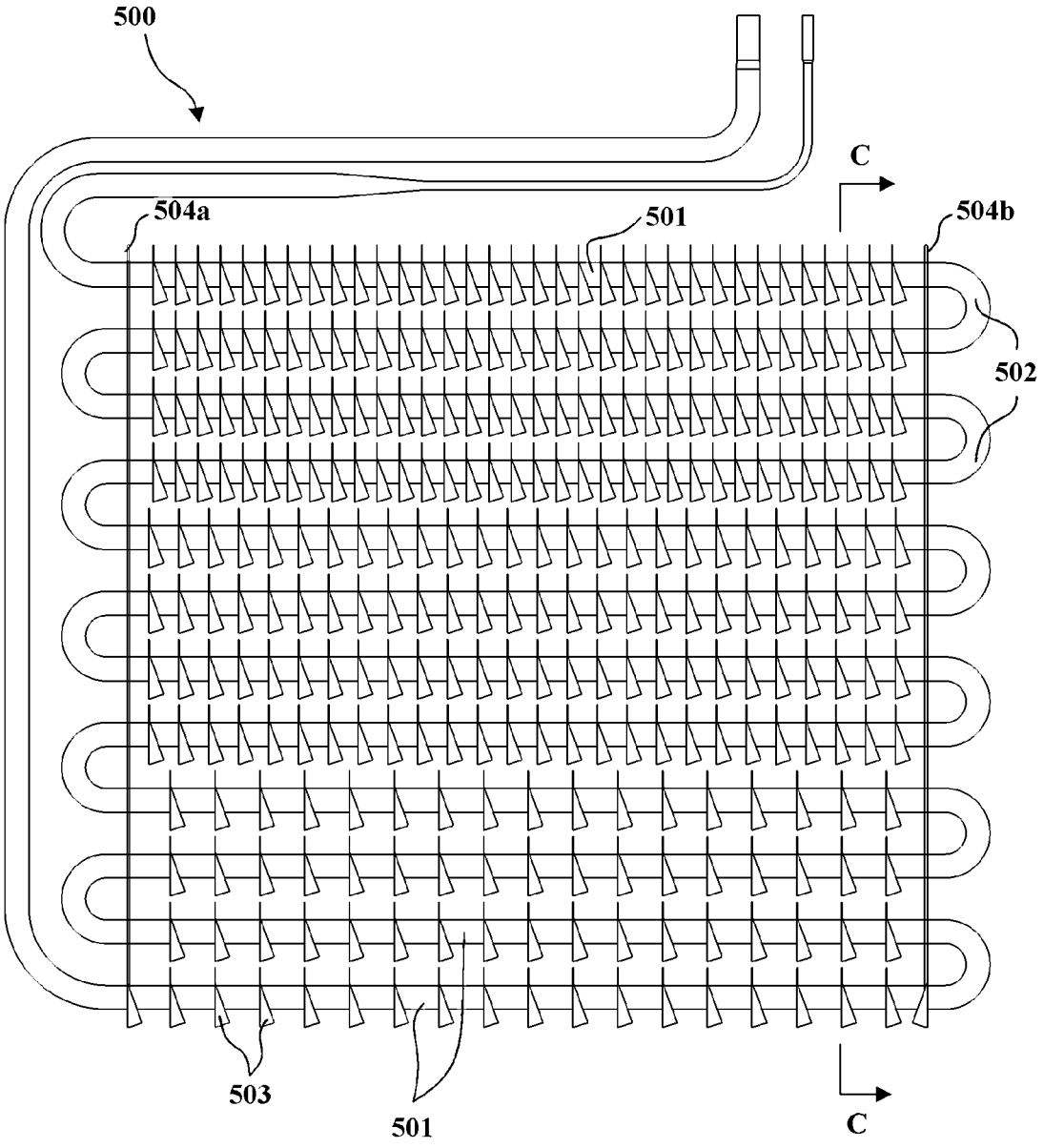
FIG. 12 is a schematic front view of an evaporator according to an embodiment of the present invention.
Figure 13:
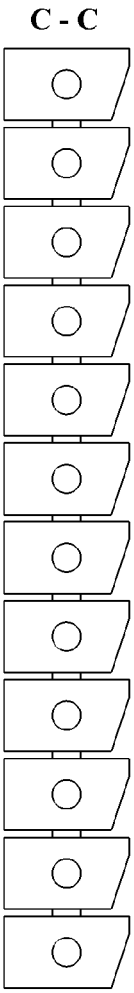
FIG. 13 is a schematic cross-sectional view taken along a section line C-C in FIG. 12.
Figure 14:
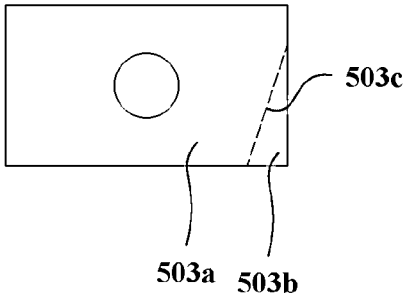
FIG. 14 is a schematic expanded view of a fin according to an embodiment of the present invention.

Referring to FIG. 12 to FIG. 14, in some embodiments of the present invention, the evaporator 500 can be provided with a plurality of linear pipelines 501 which transversely extend and are vertically arranged at intervals and a plurality of transition pipelines 502 which are connected with the linear pipelines 501. A plurality of fins 503 are parallelly mounted on each linear pipeline 501 at intervals, and plate bodies 503*a* of the fins 503 are configured to be perpendicular to the liner 100. Specifically, an oblique part 503*b* is located at the bottom of the side of a plate body 503*a* away from the liner 100, and is perpendicular to the plate body 503*a*.

That is, one end of each fin 503 is provided with a bent part. Each fin 503 can be configured to be in a rectangular sheet shape, one corner of the fin 503 is configured to bend out of a plane in which most of a plate body 503*a* of the fin 503 is located so as to form an oblique part 503*b*, and an oblique edge 503*c* is formed at the bent location of the oblique part 503*b* and the plate body 503*a* of the fin 503. Specifically, the oblique part 503*b* can be preferably a corner located outside the lower end of each fin 503 so as to guide the liquid such as defrosting water on the fin 503 to flow toward the inner side of each fin 503 along the oblique edge 503*c*, so that as a whole, the water droplets dropping from the evaporator 500 are closer to the liner 100, and the requirement for the width of the water collecting structure is reduced.

Further, in some embodiments of the present invention, the oblique part 503*b* is configured to be perpendicular to the plate body 503*a* of the fin 503 to enable the tail end of the oblique part 503*b* to be inward as much as possible, and simultaneously, the plate body 503*a* of the fin 503 and the surface of the oblique part 503*b* are kept at a certain distance to ensure the contact of the evaporator 500 with the air flowing through the evaporator 500, thereby enhancing the heat exchange efficiency.

A plurality of fins 503 mounted on each linear pipeline 501 can be configured to ensure that the bent directions of all oblique parts 503*b* are the same, so that the defrosting water dropping from the evaporator 500 is equalized. The plurality of linear pipelines 501 and the plurality of transition pipelines 502 can together constitute a serpentine pipeline, and the arrangement of the plurality of fins 503 on the plurality of linear pipelines 501 located at the upper part of the serpentine pipeline can be configured to be denser than the arrangement of the plurality of fins 503 on the plurality of linear pipelines 501 located at the lower part of the serpentine pipeline.

In some embodiments of the present invention, the evaporator 500 can be provided with two vertically extended support plates, namely a left support plate 504*a* located at the left end of the plurality of linear pipelines 501 and a right support plate 504*b* located at the right end of the plurality of linear pipelines 501. Further, each of the bottom ends of the left support plate 504*a* and the right support plate 504*b* is provided with a fin 503 with an oblique part 503*b*, and the oblique parts 503*b* of the two fins 503 located at the ends of the support plates are configured to bend toward the middle parts of the linear pipelines 501. That is, the fins 503 at the ends of the support plates can be provided with plate bodies 503*a* and oblique parts 503*b* which are substantially the same as those of the fins 503 of the linear pipelines 501. Specifically, the fin 503 of one end can be configured to have the structure which is identical to the structure of the fins 503 of the linear pipelines 501, and the fin 503 of the other end can be configured to have a structure in mirror symmetry with the fins 503 of the linear pipelines 501.

Specifically, the oblique parts 503*b* of the end fins 503 in the bent direction of the oblique parts 503*b* of the fins 503 on the linear pipelines 501 are configured to be opposite to the oblique parts 503*b* of the fins 503 on the linear pipelines 501 in bent direction, and namely are relatively bent to the oblique parts 503*b* of the fins 503 on the linear pipelines 501. Therefore, the ends of the fins 503 on the outermost side of the evaporator 500 are all bent toward the inner side of the evaporator 500 so as to improve the flow dropping location of the defrosting water and reduce the requirement for the structural size of the water collecting groove or the water collecting liner 100.

The evaporator 500 of the present invention can realize the internal movement of the dropping location of the liquid such as defrosting water only by bending one end corner of a common fin, other complicated structures are not needed, and the technical solution is simple and feasible.

Further, the bent oblique part 503*b* is located between two adjacent fins 503, that is, on the flow path of the heat exchange airflow, thereby increasing the burbling of the fins 503 to the heat exchange airflow and improving the heat exchange efficiency.

Specifically, the evaporator 500 provided with the fins 503 is especially suitable for being mounted in cooperation with the above air supply assembly. Due to the special structure of the above air supply assembly, a partial region of the liner 100 needs to protrude to the inside of the air supply space 20 beyond the size of a general evaporator 500. The evaporator 500 provided with the fins 503 can guide the defrosting water to the inside of the evaporator 500 on the premise of ensuring the heat exchange area so as to prevent the defrosting water from dropping outside the water collecting structure (that is, the water collecting bottom 101 of the liner 100), thereby simplifying the structure of the liner 100, avoiding the problem of absorption or unstable mounting of the liner 100 due to the arrangement of the bent part or the extension part of the liner 100, and further simplifying the mounting structure of the liner 100 connected with the fan rear cover 300 and other water stop structures of the air duct cover plate 200.

The present invention also provides a refrigerator 1 provided with a refrigerator body 2 comprising at least one compartment and the above air supply assembly. The at least one compartment is a refrigerating compartment 3, and the air supply assembly is arranged in the refrigerating compartment 3. Preferably, the refrigerator 1 is also provided with the evaporator 500 so as to simplify the assembly of the air supply assembly in the refrigerator.

So far, those skilled in the art should recognize that although a plurality of exemplary embodiments of the present invention have been shown and described in detail herein, many other variations or modifications consistent with the principles of the present invention still can be directly determined or derived according to the disclosed contents of the present invention without departing from the spirit and scope of the present invention. Therefore, the scope of the present invention should be understood and recognized as covering all other variations or modifications.

The invention claimed is:

1. An air supply system for a refrigerator, comprising an air supply assembly, comprising:

an air duct cover plate which defines an air supply space together with a refrigerator liner and isolates the air supply space from a storage space in a compartment of the refrigerator, and a centrifugal wind wheel which is arranged in the air supply space, axially sucks air in and blows out the air to a peripheral side, wherein the air duct cover plate is provided with a plurality of air return ports for allowing the air in the storage space to enter the air supply space; and the centrifugal wind wheel abuts against the inner side of the air duct cover plate and suctions air in from the rear side so as to draw the air entering the air supply space via the air return ports in from the rear side of the centrifugal wind wheel, wherein the air supply assembly is located on the rear side of a lower part of the compartment, and an airflow channel is arranged above the air supply assembly;

an evaporator is arranged in the airflow channel, and the airflow channel is provided with an air supply port for supplying air to the storage space;

the centrifugal wind wheel enables the air to accelerate upward and flow into the airflow channel and flow to the air supply port through the evaporator;

wherein the evaporator is arranged above the centrifugal wind wheel and exchanges heat with the air flowing through the evaporator;

wherein the centrifugal wind wheel axially sucks air in from the centrifugal wind wheel and blow out the air upward;

a part of the liner located below the evaporator directly bends and extends toward the air duct cover plate so as to form a water collecting bottom, and the part of the liner enables a projection of the evaporator in a vertical direction to be in the water collecting bottom;

wherein the part of the liner located below the evaporator and located above the water collecting bottom protrudes away from the air duct cover plate so as to form a water collecting side protruding toward a foaming layer of the refrigerator;

wherein the water collecting bottom is configured such that a side close to the air duct cover plate is higher than a side close to the water collecting side, so that water droplets falling on the water collecting bottom flow toward the water collecting side; and wherein a junction of the water collecting side and the water collecting bottom has an inclination angle to ensure that a middle location is lower than other locations away from the middle location and the junction inclines downwards and is away from an air outlet duct of the centrifugal wind wheel, and the middle location is provided with a drain opening for guiding a liquid flowing to the junction to flow out from the drain opening.

2. The air supply system according to claim 1, wherein a region of the liner corresponding to the centrifugal wind wheel protrudes outward away from the air duct cover plate so as to increase the air supply space on an air suction side of the centrifugal wind wheel.

3. The air supply system according to claim 1, wherein the air duct cover plate is directly mounted and fixed on the refrigerator liner, the inner side of the air duct cover plate is provided with a fan volute, and the centrifugal wind wheel is arranged in the fan volute.

4. The air supply system according to claim 3, wherein the fan volute is formed on the inner side of the air duct cover plate so as to mount the centrifugal wind wheel; and the fan volute integrally formed with the air duct cover plate.

5. The air supply system according to claim 3, also comprising:

a fan rear cover which is arranged between the centrifugal wind wheel and the liner and covers the outside of the centrifugal wind wheel from the rear side of the centrifugal wind wheel, wherein the fan rear cover is provided with an air suction port for allowing the centrifugal wind wheel to draw the air from the air supply space in through the air suction port;

the fan rear cover, the fan volute, and the centrifugal wind wheel constitute a centrifugal fan; and the fan volute is provided with a locating notch, the fan rear cover is provided with a locating pillar extending forward from a front surface of the fan rear cover, and the locating pillar is inserted into the locating notch when the fan rear cover is mounted on the inner side of the air duct cover plate.

6. The air supply system according to claim 5, wherein the fan rear cover is directly mounted and fixed on the air duct cover plate between the centrifugal wind wheel and the liner.

7. The air supply system according to claim 5, wherein the air supply assembly further comprising a shielding strip arranged at the top of the fan rear cover, extending backward from the top of the fan rear cover and partially overlapping on the water collecting bottom to shield an air return region between the liner and the fan rear cover.

8. The air supply system according to claim 7, wherein a side, connected to the fan rear cover, of the shielding strip is lower than a top end of the fan rear cover, and is higher than a side of the shielding strip overlapping on the water collecting bottom.

9. The air supply system according to claim 3, wherein the air duct cover plate comprises a main part and a guide part, and the fan volute is arranged on the inner side of the main part;

the main part is arranged away from the liner with respect to the airflow channel; and the guide part bends and extends upward from a top end of the main part and toward the liner to guide the air blown out by the centrifugal wind wheel to flow to the airflow channel.

10. The air supply system according to claim 9, wherein the main part is provided with at least one air return group, and each air return group comprises the plurality of air return ports;

the air return group is located in a region close to a transverse end of the main part; and projections of the plurality of air return ports of the air return group on the air duct cover plate are located outside a projection of the fan volute on the air duct cover plate.

11. The air supply system according to claim 10, also comprising:

a plurality of shielding caps which are respectively arranged above the plurality of air return ports of the air return group on the side of the storage space so as to shield the air return ports from the upper side, so that the air in the storage space flows to an inner side of the shielding caps from bottom to top and enters the air return ports.

12. The air supply system according to claim 9, wherein the air supply assembly further comprises a plurality of guide ribs sequentially arranged at intervals on the inner side of the guide part along a transverse direction of the air duct cover plate to divide an airflow blown out by the centrifugal wind wheel into multiple strands.

13. The air supply system according to claim 1, wherein at least one transverse side end of the air duct cover plate is provided with a side cover plate which bends and extends toward the liner; and the side cover plate is provided with at least one air return port.

14. A refrigerator provided with a refrigerator body comprising at least one compartment and the air supply system according to claim 1, wherein the at least one compartment is a refrigerating compartment, and the air supply assembly of the air supply system is arranged in the refrigerating compartment.

15. The air supply system according to claim 1, wherein:

the evaporator comprises a plurality of linear pipelines transversely extending and vertically arranged at intervals and a plurality of transition pipelines connected with the linear pipelines;

a plurality of fins parallelly mounted on each linear pipeline at intervals, wherein each fin comprises a plate body perpendicular to the liner and an oblique part located at the bottom of a side of the plate body away from the liner and perpendicular to the plate body; and the end of each fin of the plurality of fins on an outermost side of the evaporator are all bent towards the inner side of the evaporator.

* * * * *